US007242353B2

(12) United States Patent
Hung et al.

(10) Patent No.: US 7,242,353 B2
(45) Date of Patent: Jul. 10, 2007

(54) BRACKET-ANTENNA ASSEMBLY AND MANUFACTURING METHOD OF THE SAME

(75) Inventors: Chen-Ta Hung, Tu-Chen (TW); Lung-Sheng Tai, Tu-Chen (TW); Yung-Lung Ke, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 141 days.

(21) Appl. No.: 10/992,038

(22) Filed: Nov. 17, 2004

(65) Prior Publication Data

US 2005/0104788 A1 May 19, 2005

(30) Foreign Application Priority Data

Nov. 18, 2003 (TW) ..... 92132256 A

(51) Int. Cl.
*H01Q 1/24* (2006.01)

(52) U.S. Cl. ..... 343/702; 343/892; 343/853; 343/872

(58) Field of Classification Search ..... 343/702, 343/700 MS, 853, 892
See application file for complete search history.

(56) References Cited

U.S. PATENT DOCUMENTS 5,138,328 A 8/1992 Zibrik et al.
6,339,400 B1 1/2002 Flint et al.
6,339,404 B1 1/2002 Johnson et al.
6,509,877 B2 1/2003 Masaki
6,531,985 B1 3/2003 Jones et al.
6,809,690 B2 * 10/2004 Tao ..... 343/702
6,836,252 B2 * 12/2004 Tai et al. ..... 343/702
6,864,845 B2 * 3/2005 Kuo et al. ..... 343/702
7,072,690 B2 * 7/2006 Shin et al. ..... 455/557
2003/0090426 A1 * 5/2003 Sun et al. ..... 343/770
2004/0090374 A1 * 5/2004 Kuo Dai et al. ..... 343/700 MS
2004/0164909 A1 * 8/2004 Yokochi et al. ..... 343/702
2004/0257283 A1 * 12/2004 Asano et al. ..... 343/702
2005/0170858 A1 * 8/2005 Tao ..... 455/550.1
2006/0001577 A1 * 1/2006 Smith et al. ..... 343/702

* cited by examiner

*Primary Examiner*—Trinh Vo Dinh
(74) *Attorney, Agent, or Firm*—Wei Te Chung

(57) ABSTRACT

A bracket-antenna assembly (3*a*) for transmitting and receiving electromagnetic waves as well as supporting a liquid crystal display of an electronic device is disclosed. The bracket-antenna assembly is formed by a side of a loop bracket (3) and includes a first antenna (41) and a second antenna (42) having the same structure with the first antenna and arranged symmetrically to the first antenna on the side of the bracket. Each of the antennas includes two inverted-F antennas operating at different frequency bands. A remained portion of the bracket acts as a grounding portion (30) of both the first and the second antennas.

13 Claims, 10 Drawing Sheets

BRACKET-ANTENNA ASSEMBLY AND MANUFACTURING METHOD OF THE SAME

BACKGROUND OF THE INVENTION

1. Field of the Invention

The present invention relates generally to a bracket-antenna assembly and the manufacturing method of the assembly. The invention relates to the application Ser. No. 10/330.959 having the some common applicants and the same assignee therewith.

2. Description of the Prior Art

With the development of wireless communication in the recent years, many terminal devices, such as a desktop computer, a notebook computer, a printer, and the like, are required to have capability of communicating with each other or external networks wirelessly. Therefore, an antenna for transmitting and receiving RF signals is needed.

As is well known, the factor of multipath strongly effects the reception of an antenna in wireless systems, research on antenna diversity is employed to solve such a problem. It is necessary to employ a certain form of antenna diversity to combat multipath effects. The antenna diversity can be accomplished in the form of frequency diversity, time diversity, or spatial diversity. In frequency diversity, the system switches between frequencies to combat multipath interference. In time diversity systems, the signal is transmitted or received at two different times. In spatial diversity systems, two or more antennas are placed at physically different locations to combat multipath interference.

An integral diversity antenna arrangement suited for use in a laptop computer device is disclosed in U.S. Pat. No. 5,138,328. The laptop computer device has an associated liquid crystal display (LCD). The antenna arrangement comprises an integral counterpoise and electromagnetic shielding structure adapted for location within the laptop computer. A pair of separately located printed circuit board based antennas are located form an edge surface of the counterpoise at locations which provide both spatial and polarization diversity for received RF signals. A similar integrated antenna suited for use in the laptop computer device is also disclosed in U.S. Pat. No. 6,339,400. In this case, the laptop computer comprises a display mounted on a metal frame. The antenna comprises a radiating element extending from the metal frame, and a conductor comprising a first component for conducting a signal and a second component connected to the metal frame for grounding the antenna. Whatever the position of mounting the antennas, in each of the two mentioned-above prior arts, two or more antennas should be used for mounting on different positions of the LCD for spatial diversity. Though connecting the antenna with the counterpoise of the LCD or the metal frame of the LCD can increase the grounding area of the diversity antennas, the fixing of the antennas with screws or other accessories oppresses the antennas and diversely affects the grounding effect of the antennas. Furthermore, manufacturing separately two or more antennas for one laptop and mounting the antennas separately in different positions are very complex. Additionally, the antennas occupy an excess space in the laptop computers.

U.S. Pat. No. 6,339,400 also discloses another embodiment that two inverted-F antennas and two slot antennas are integrally formed on a shielding foil of the LCD as an antenna module. In other words, the shielding foil of the LCD is forging into an antenna module which comprises four antennas. Though the antenna module economizes the limited space in the laptop computer and strengthens the connection of the antennas and the laptop computers, the shielding foil is so big that it is very difficult to forge. Moreover, the shielding foil defines a plurality of slots in order to form the antennas, which adversely affects the shielding of electrical magnetism interference (EMI) on the edge of the LCD.

Hence, synthetically consider the factors of simplification and convenience of manufacture, an bracket-antenna assembly and a method of manufacturing the system are provided to overcome the above-mentioned disadvantages of the prior art.

BRIEF SUMMARY OF THE INVENTION

A primary object, therefore, of the present invention is to provide a bracket-antenna assembly used in an electronic device.

Another object, therefore, of the present invention is to provide a manufacturing method of the bracket-antenna assembly.

In order to implement the above objects and overcome the above-identified deficiencies in the prior arts, a bracket-antenna assembly formed by a loop bracket which is disposed around a display device of an electronic device and is provided for cushioning supporting the display device is disclosed. The bracket-antenna assembly comprises a first antenna and a second antenna having the same structure as the first antenna and being mounted symmetrically to the first antenna on the bracket. Each of the antennas comprises two inverted-F antennas operating at different frequency bands. A remained portion of the loop bracket acts as a grounding portion of both the first and the second antennas.

A manufacturing method of the bracket-antenna assembly comprises designing the first and the second antenna having the symmetrical structure with each other, preparing a bracket of a display device, selecting two suitable areas on a left end and a right end of the bracket, and punching and stamping the bracket respectively at the two areas to form the first antenna and the second antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
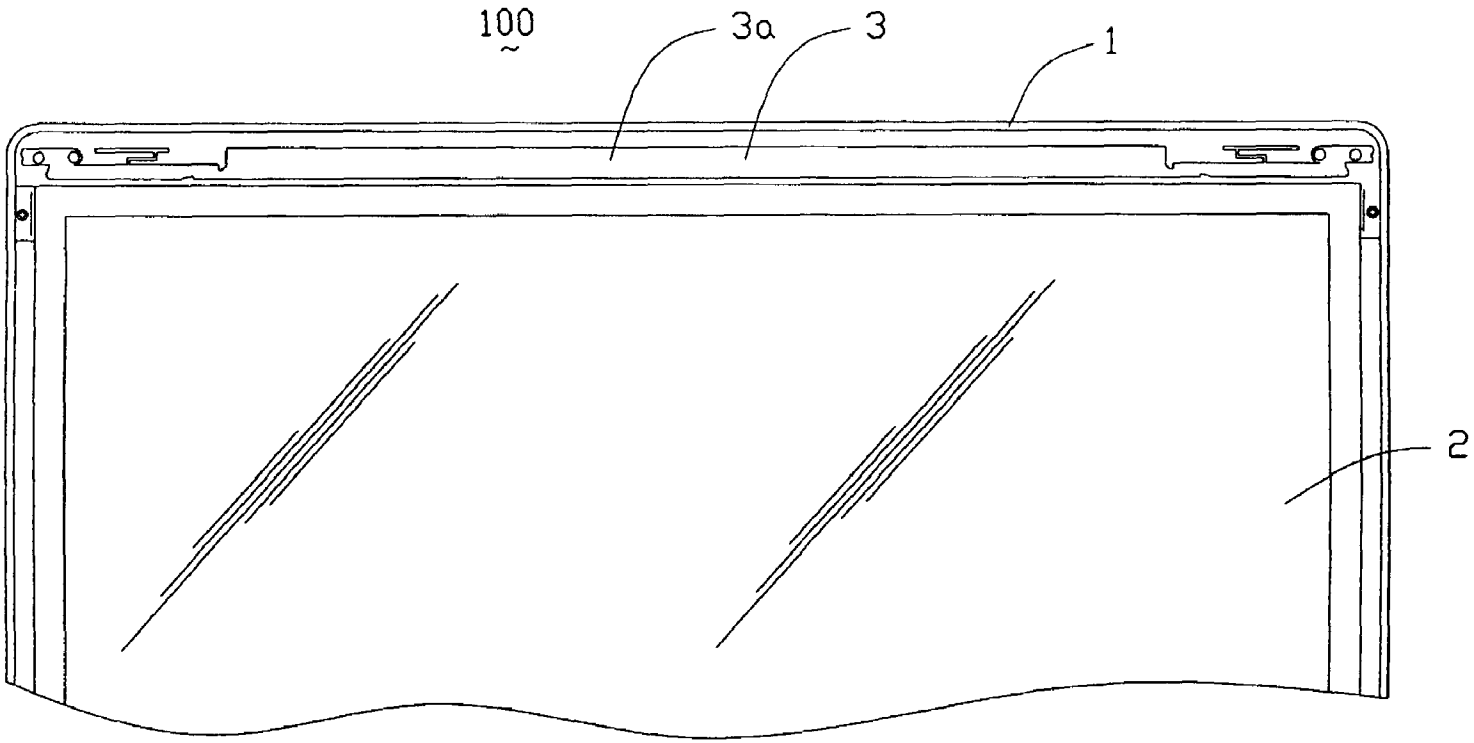
FIG. 1 is a planar view of an electronic device having a bracket-antenna assembly assembled in a display system of a preferred embodiment in accordance with the present invention.

Referring to FIG. 1, a bracket-antenna assembly 3*a* of the present invention is used with an electronic device (not shown) having a display system 100. The display system comprises a display device which in this preferred embodiment is a liquid crystal display (LCD) 2 and defines a frame (not labeled), a loop bracket 3 which is made of elastomeric metal for enclosing and supporting the LCD 2 and comprises one or two horizontal sides (not labeled) and two vertical sides (not shown), and a dielectric cover 1 having a rectangular edge (not labeled) and defining a receiving space (not labeled) which is divided into a main receiving space for receiving the LCD 2 and a secondary receiving space which is remained between the rectangular edge of the dielectric cover 1 and the frame of the LCD 2 and is provided for receiving the loop bracket 3.

Figure 2:
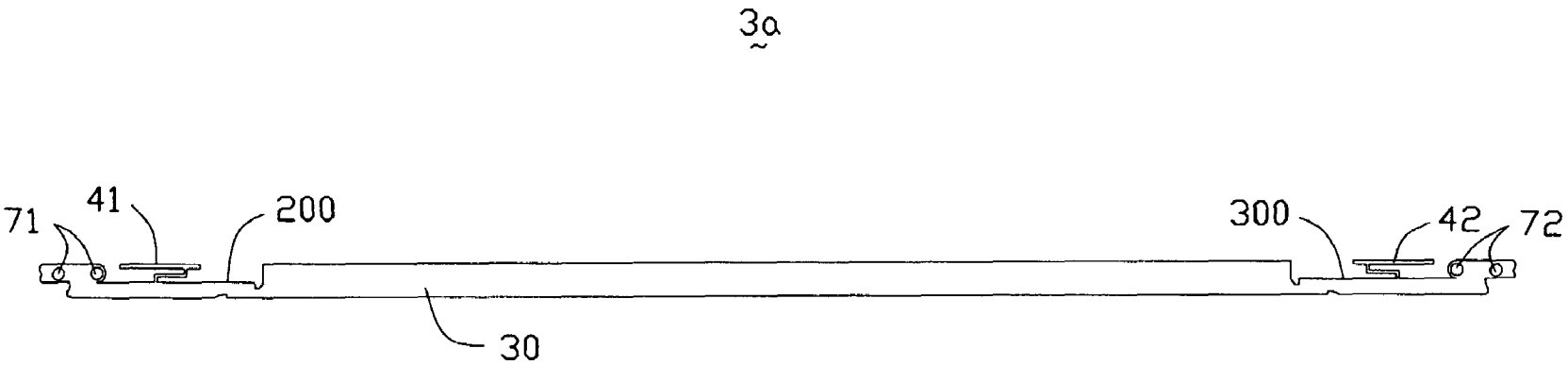
FIG. 2 is a planar view of the bracket-antenna assembly of FIG. 1.

Referring to FIG. 2, now take one of the horizontal sides of the loop bracket 3 into account to form into a long striped bracket-antenna assembly 3*a* in according to the preferred embodiment. The loop bracket-antenna assembly 3*a* forms a first antenna 41 and a second antenna 42 respectively on a left end 200 and a right end 300 of the bracket-antenna assembly 3*a*. A remained portion of the bracket 3 acts as a grounding portion 30 of the two antennas 41 and 42. The left end 200 and the right end 300 respectively defines a first gap (not labeled) and a second gap (not labeled). The first antenna 41 is arranged in the first gap. The second antenna 42 is arranged in the second gap. The first antenna 41 and the second antenna 42 are exactly of the same structure and are symmetrically disposed on the bracket-antenna assembly 3*a* for spatial diversity. A circuit (not shown) is provided for selecting one of the receiving signals or feeding signals of the two antennas 41 and 42 which is stronger. The left end and the right end separately define a plurality of fixing holes 71 and 72 for mounting the bracket-antenna assembly 3*a* into the electronic device.

Figure 3:
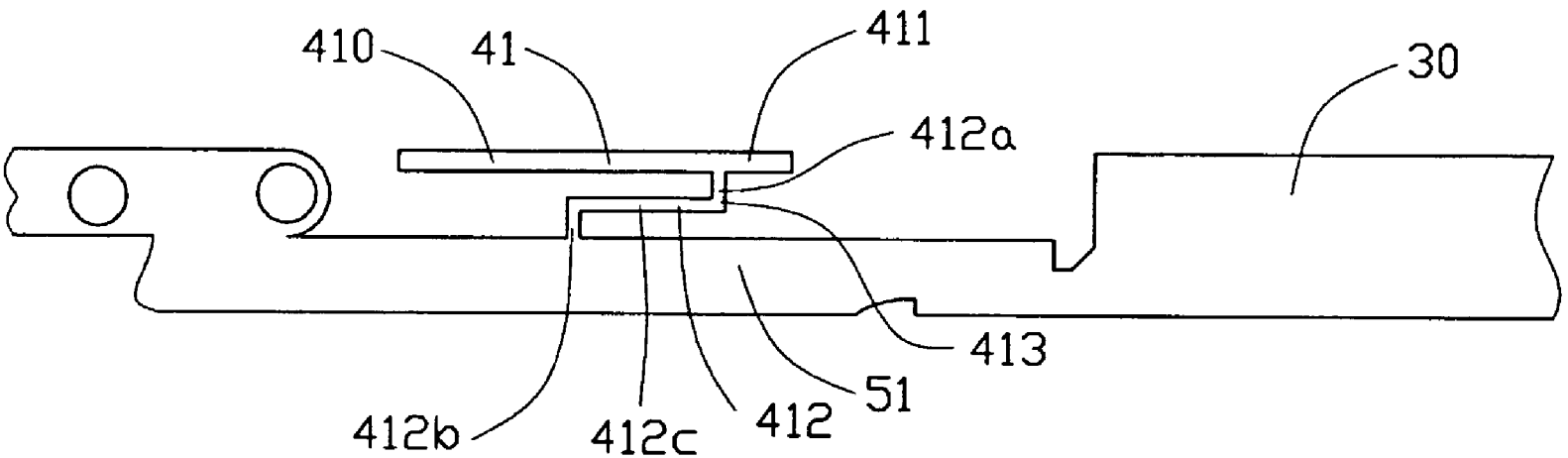
FIG. 3 is an enlarged partially view of FIG. 2.
Figure 4:
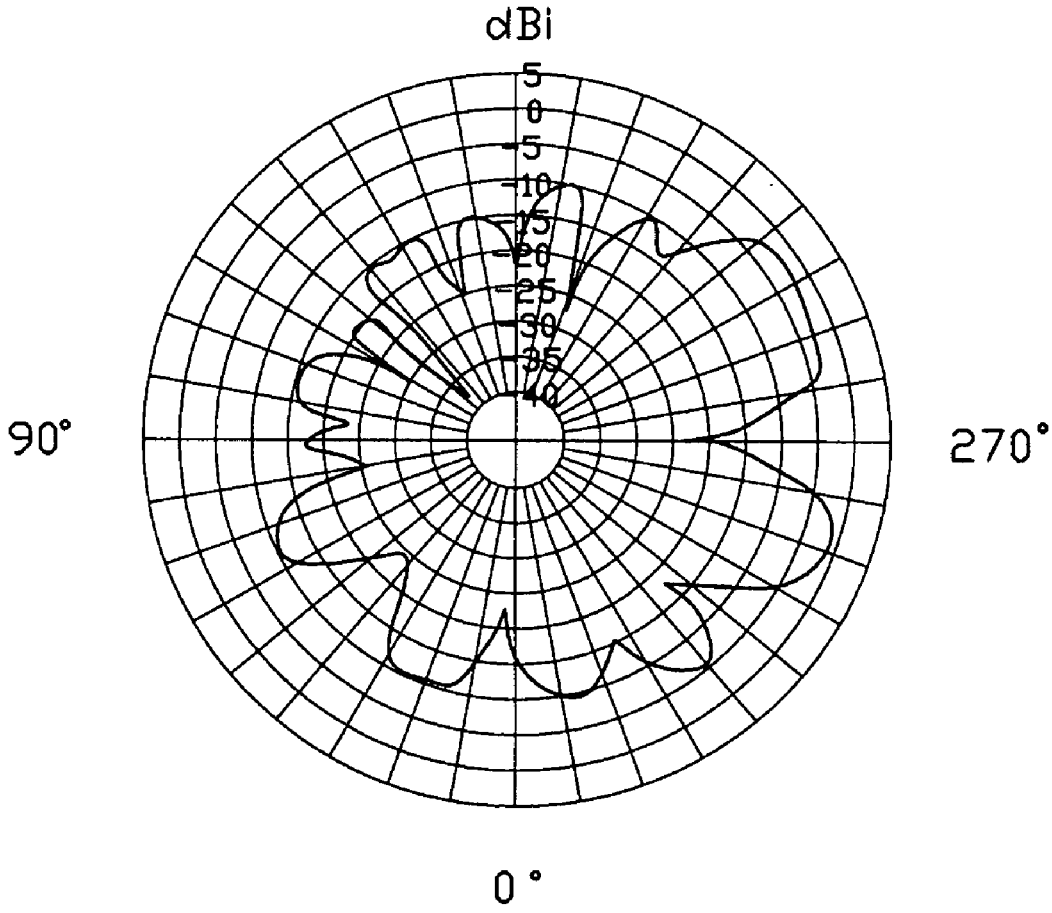
FIG. 4 is a horizontally polarized principle plane radiation pattern of an first antenna of the bracket-antenna assembly operating at the frequency of 2.45 GHz.
Figure 5:
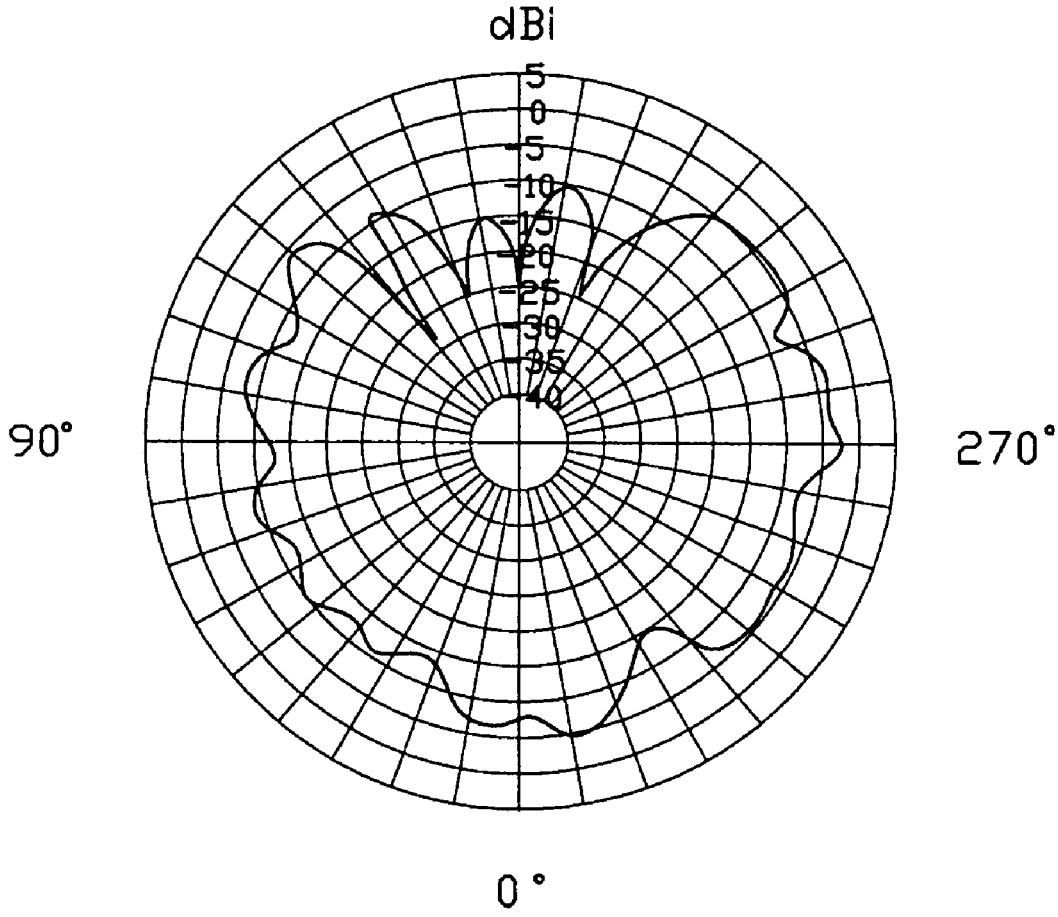
FIG. 5 is a vertically polarized principle plane radiation pattern of the first antenna operating at the frequency of 2.45 GHz.
Figure 6:
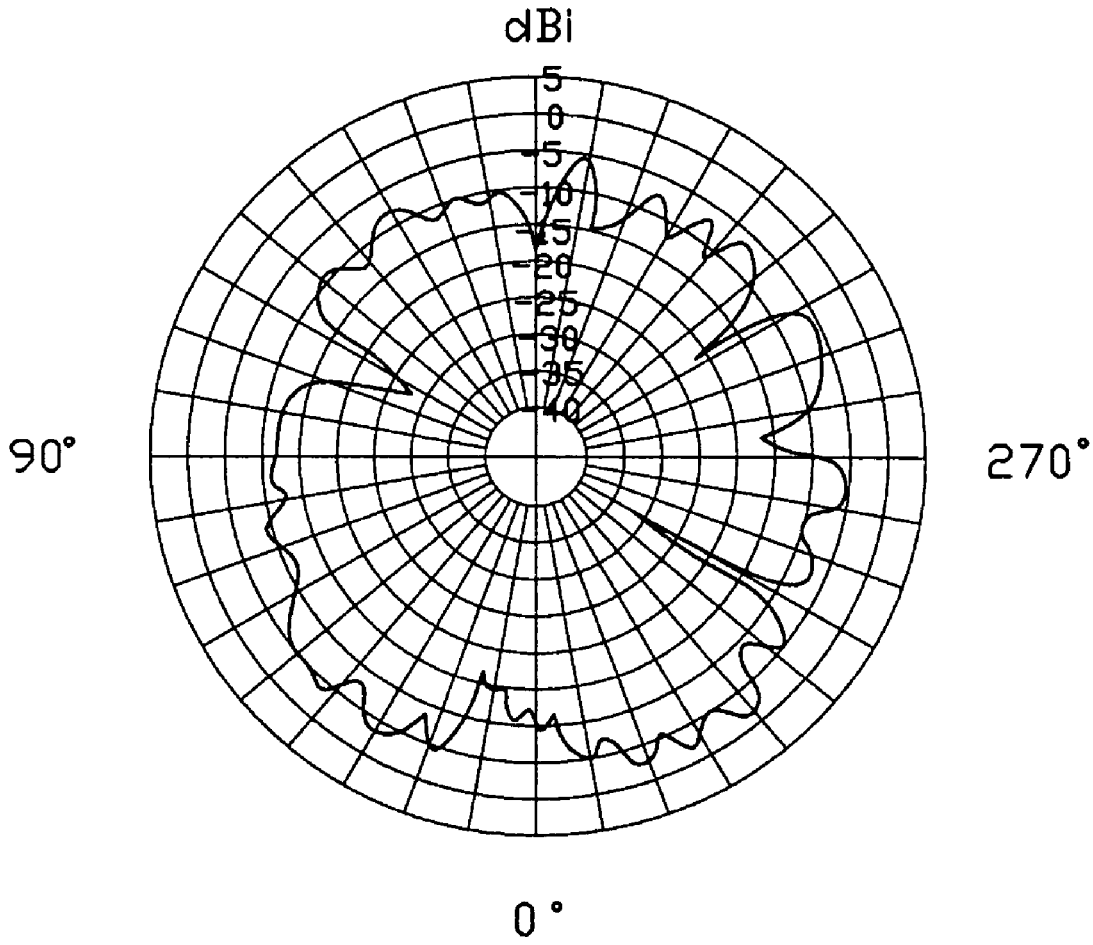
FIG. 6 is a horizontally polarized principle plane radiation pattern of the first antenna operating at the frequency of 5.25 GHz.
Figure 7:
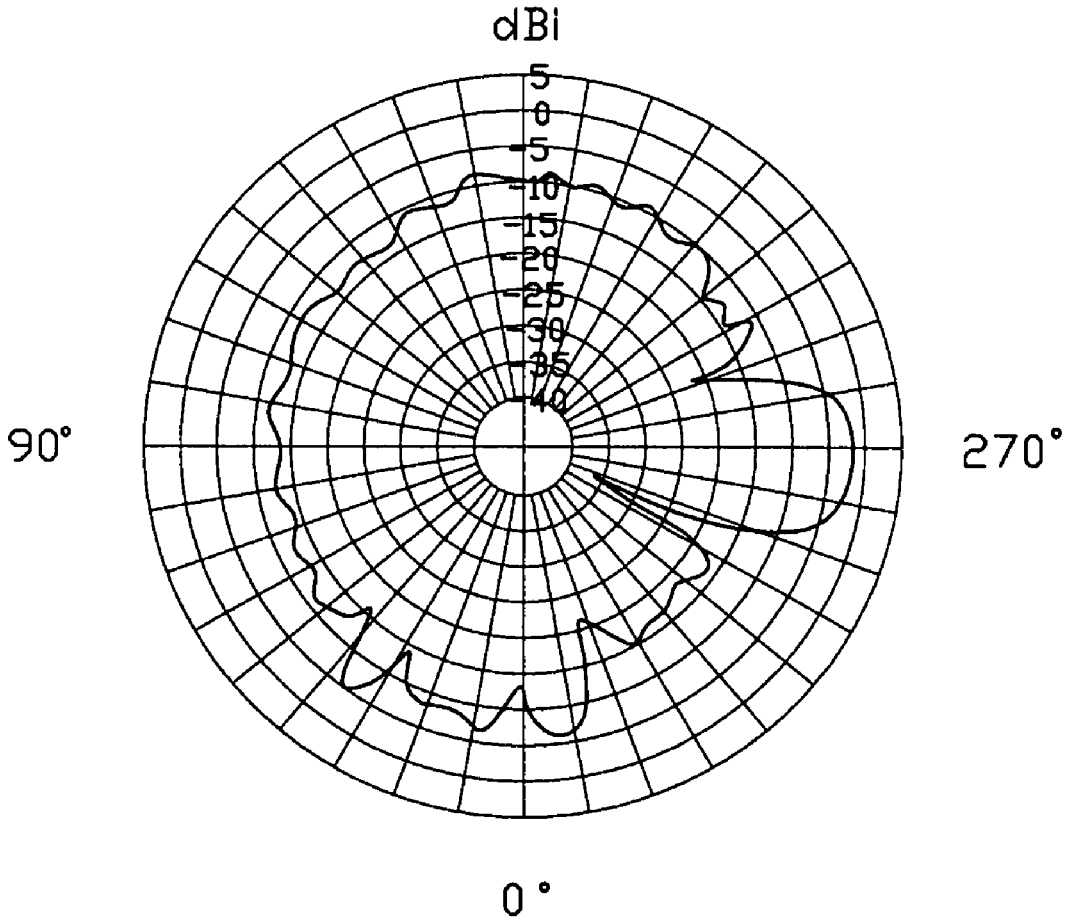
FIG. 7 is a vertically polarized principle plane radiation pattern of the first antenna operating at the frequency of 5.25 GHz.
Figure 8:
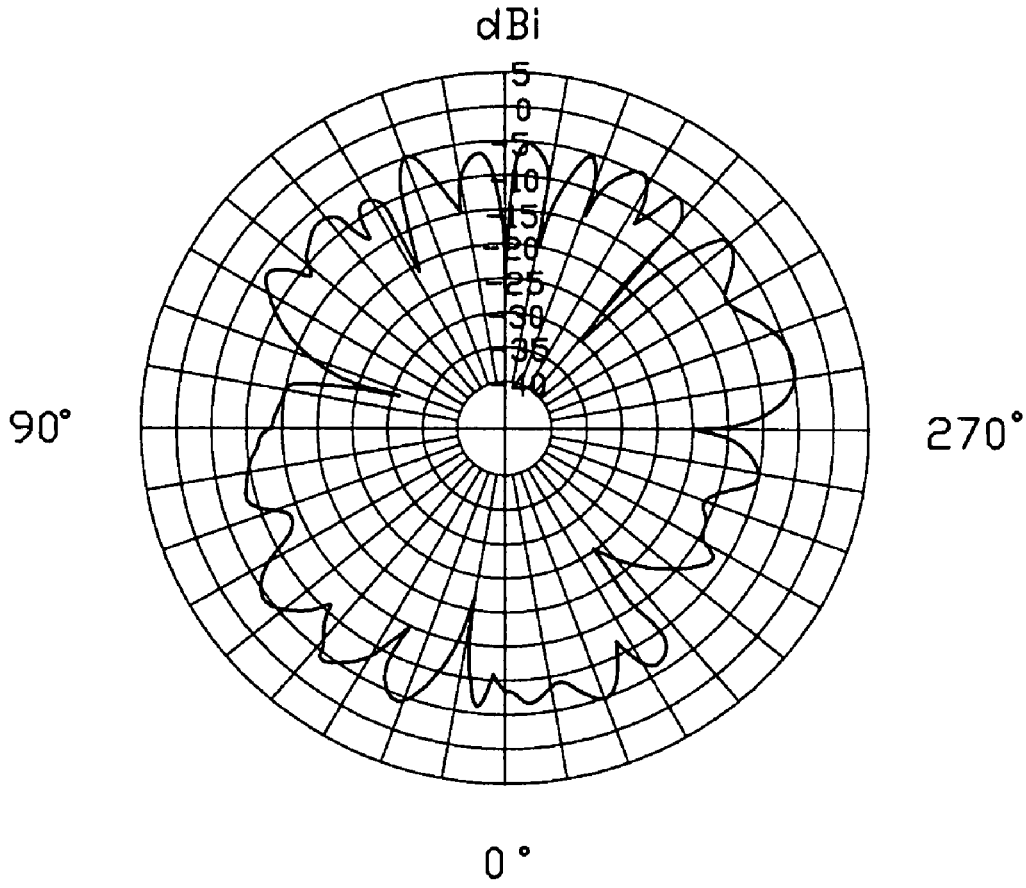
FIG. 8 is a horizontally polarized principle plane radiation pattern of the first antenna operating at the frequency of 5.725 GHz.
Figure 9:
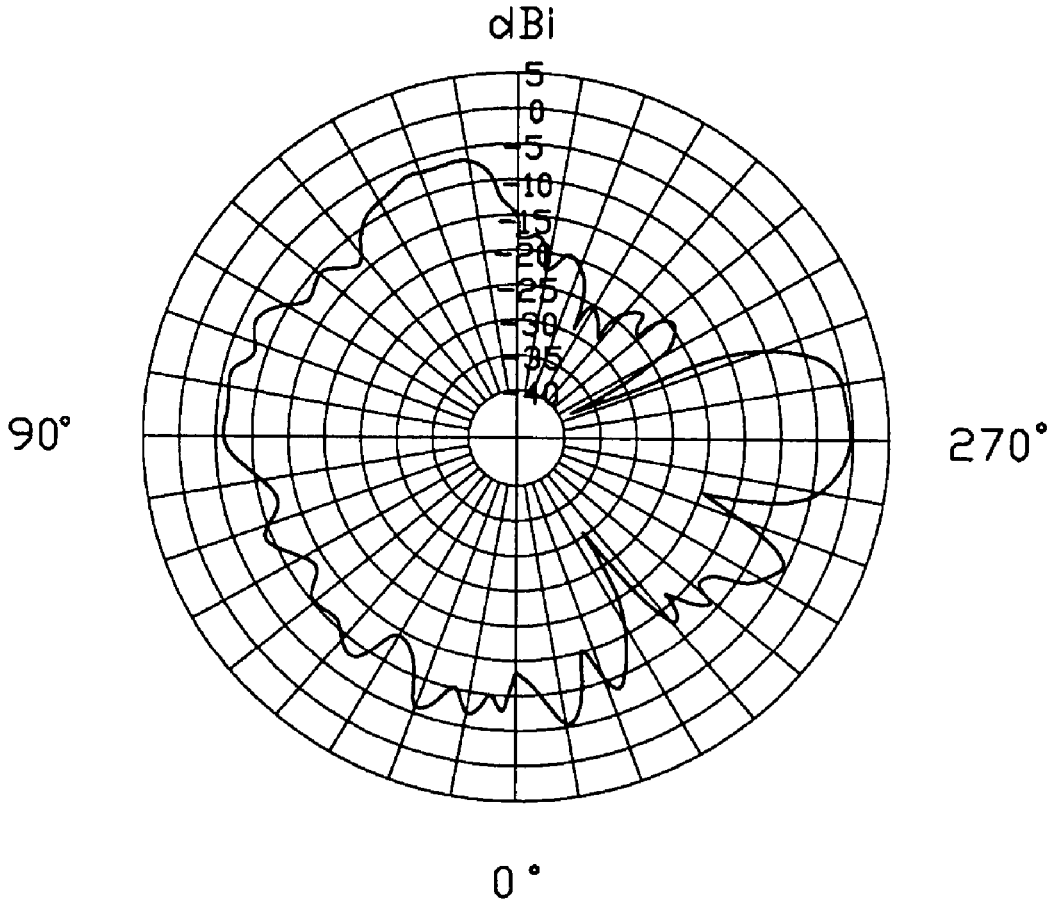
FIG. 9 is a vertically polarized principle plane radiation pattern of the first antenna operating at the frequency of 5.725 GHz.

Referring to FIG. 3, the first antenna 41 comprises a first radiating arm 410, a second radiating arm 411, a connecting portion 412, and a feed point 413. The connecting portion 412 is step-shaped and extends upwardly from the grounding portion 30. The connecting portion 412 comprises an upper portion 412*a*, a lower portion 412*b* and a mid portion 412*c*. The upper and the lower portions 412*a* and 412*b* are vertical and are perpendicular to the grounding portion 30, while the mid portion 412*c* is horizontal and is parallel to the grounding portion 30. The mid portion 412*c* connects the upper and the lower portions 412*a* and 412*b*. The first radiating arm 410 extends leftwardly from the upper portion 412*a*. The second radiating arm 411 extends rightwardly from the upper portion 412*a*. The first and the second radiating arms 410 and 411 are both horizontal and are parallel to the grounding portion 30. The two radiating arms 410 and 411 are of the same height and of different lengths. The feed point 413 is disposed at the position of a joint of the upper portion 412*a* and the mid portion 412*c*. A feed cable (not shown) is used for feeding the antenna 41. The feed cable comprises an inner conductor electrically connected to the feed point 413 and an outer conductor electrically connected to the grounding portion 30. The first radiating arm 410, the connecting portion 412 and the feed cable form an inverted-F antenna operating at a lower frequency band of 5.15–5.875 GHz. The second radiating arm 411, the connecting portion 412 and the feed cable form another inverted-F antenna operating at a higher frequency band of 2.4–2.82 GHz. One skilled in the art will appreciate that the current in the radiating arms travels from the feed point 413 to the ends of the radiating arms 410 and 411. The two radiating arms 410 and 411 are resonant at two different frequencies. By controlling the lengths of the radiating arms 410 and 411, the lower and higher operating frequencies of the first antenna 41 can be adjusted.

Referring to FIGS. 4–9, note that each radiation pattern of the antenna 41 is close to a corresponding optimal radiation pattern and there is no obvious radiating blind area, conforming to the practical use conditions of an antenna.

Figure 10:
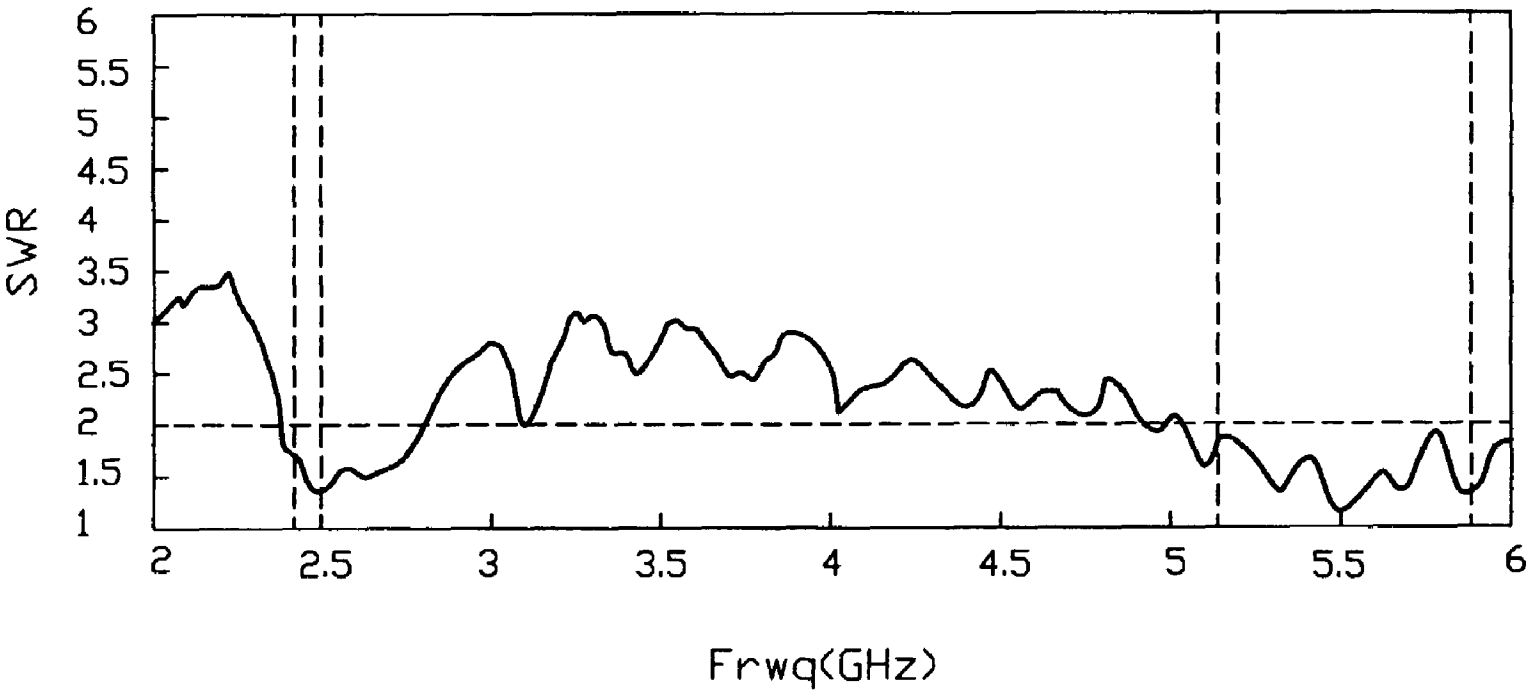
FIG. 10 is a test chart recording of Voltage Standing Wave Ratio (VSWR) of the first antenna as a function of frequency.

FIG. 10 sets forth a test chart recording of Voltage Standing Wave Ratio (VSWR) of the antenna 41 as a function of frequency. Note that VSWR drops below the desirable maximum value "2" in the 2.4 G–2.5 GHz frequency band and in the 5.15 G–5.875 GHz frequency band, indicating acceptable efficient operation in these two wide frequency bands, which cover more than the total bandwidth of nearly all protocols or standards of short-range wireless communications, for example, IEEE 802.11a/b/g, Bluetooth, HomeRF, and so on.

The bracket-antenna assembly 3*a* having the above structure is manufactured by means of example as follows:

First, designing a structure of the first antenna 41, comprising computing the first total length of the first radiating arm 410 and the connecting portion 412 according to the first operating frequency of the antenna 41, computing the total length of the second radiating arm 411 and the connecting portion 412 according to the second operating frequency of the antenna 41, computing the height between the radiating arms 410 and 411 and the first horizontal element 51 according to the ranges of the working frequency bands, and conforming the position of the feed point 413 on the connecting portion 412 according to the impedance matching. Second, preparing a bracket 3 which supports the LCD 2 in an electronic device. Third, selecting two suitable areas respectively on the left end 200 and the right end 300 of the bracket 3. Fifth, punching and stamping the bracket 3 respectively at the two areas mentioned above to form the antennas 41 and 42 which is of the same structure and is just arranged symmetrically of the first antenna 41.

The bracket-antenna assembly 3*a* of the present invention can also be formed by other sides of the loop bracket besides the horizontal side. Moreover, any compact antenna can be formed on the bracket, for example, an inverted-F antenna, a loop antenna, a slot antenna, and so on. Furthermore, three or more antennas can be arranged at proper positions on the loop bracket for spatial diversity. The structures of these antennas may be different.

Integrating a bracket and an antenna to form a bracket-antenna assembly can economize the limited space in the electronic devices, increasing the structure strengthen of the antennas, increasing the grounding area, simplify the manufacture process, and reduce the manufacture cost. Additionally, the bracket-antenna assembly can be standardized into a standard bracket module and used in different types of electronic devices. So the researching and developing time of an antenna is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A display system, comprising:

a display device having a frame;

a bracket-antenna assembly which is made of a loop bracket for stretched supporting the display device and is arranged around the display device, the bracket-antenna assembly comprising a first antenna and a second antenna; and a dielectric cover having an edge and defining a receiving space which comprises a main receiving space for receiving the display device and a secondary receiving space remained between the edge of the dielectric cover and the frame of the display device for receiving the bracket-antenna assembly.

2. The display system as claimed in claim 1, wherein each of the first and the second antennas comprises a connecting portion extending form the bracket, a first radiating arm extending from the connecting portion, a second radiating arm extending from the connecting portion in an opposite direction of the first radiating arm, and a feed point being settled on the connecting portion.

3. The display system as claimed in claim 2, wherein the first radiating arm and the second radiating arm are of the same height and of different lengths.

4. The display system as claimed in claim 2, wherein the connecting portion is step-shaped.

5. The display system as claimed in claim 1, wherein the loop bracket comprises two horizontal sides and two vertical sides.

6. The display system as claimed in claim 5, wherein bracket-antenna assembly is formed of one side of the loop bracket.

7. The display system as claimed in claim 1, wherein the first antenna and the second antenna are symmetrically disposed on the bracket-antenna assembly.

8. The display system as claimed in claim 1, wherein the first antenna and the bracket form an inverted-F antenna, the bracket providing a grounding portion for the inverted-F antenna.

9. The display system as claimed in claim 1, wherein the second antenna and the bracket form an inverted-F antenna, the bracket providing a grounding portion for the inverted-F antenna.

10. A display system comprising:

a rectangular display device;

a metallic bracket supportably surrounding, at least partially, the display device; and a dielectric cover enclosing said metallic bracket and said display device; wherein in some areas of the bracket, some portions are intentionally removed to form two antenna structures disposed oppositely along an elongated section of said metal bracket, and a feed cable is connected thereto; wherein there are two antenna structures are formed oppositely along an elongated section of said bracket.

11. The display system as claimed in claim 10, wherein said antenna structure is of an inverted F configuration.

12. The display system as claimed in claim 10, wherein other areas function as grounding.

13. The display system as claimed in claim 10, wherein said two antenna structures are symmetrically arranged with each other.

* * * * *